United States Patent [19]

Louhio

[11] 4,445,423

[45] May 1, 1984

[54] HYDRAULIC MOTOR

[75] Inventor: Ilmari Louhio, Helsinki, Finland

[73] Assignee: Oy Partek AB, Finland

[21] Appl. No.: 249,710

[22] Filed: Mar. 31, 1981

[30] Foreign Application Priority Data

Apr. 14, 1980 [FI] Finland ..... 801183

[51] Int. Cl.[3] ..... F01B 13/06; F01B 25/00

[52] U.S. Cl. ..... 91/492

[58] Field of Search ..... 91/491, 492, 497, 477

[56] References Cited

U.S. PATENT DOCUMENTS

| | | | |
|---|---|---|---|
| 1,998,004 | 4/1935 | Ernst | 91/477 |
| 2,163,080 | 6/1939 | Benedor | 91/492 |
| 3,863,447 | 2/1975 | Foster | 91/492 |
| 4,326,450 | 4/1982 | Bacquie | 91/491 |

FOREIGN PATENT DOCUMENTS

| | | | |
|---|---|---|---|
| 888206 | 12/1952 | Fed. Rep. of Germany | 91/491 |
| 1322891 | 7/1973 | United Kingdom | 91/492 |
| 1352514 | 5/1974 | United Kingdom | 91/491 |
| 193243 | 4/1967 | U.S.S.R. | 91/492 |

*Primary Examiner*—William L. Freeh

*Attorney, Agent, or Firm*—Scully, Scott, Murphy & Presser

[57] ABSTRACT

The invention relates to a hydraulic motor with two cylinder sets of different diameters and with a slide valve for directing a pressure medium simultaneously to both cylinder sets or to either one of them. In order to achieve smooth shifting from one driving state to another, the slide valve comprises means for connecting the pressure openings of the disconnected cylinder set to a space wherein return pressure prevails, whereby the pistons of the said cylinder set passively will follow the rolling space of the cam ring of the motor. The valve structure further comprises means for connecting the pressure openings of both cylinder sets with the said space of return pressure, if the work pressure of the motor approaches the return pressure.

9 Claims, 12 Drawing Figures

FIG. 1
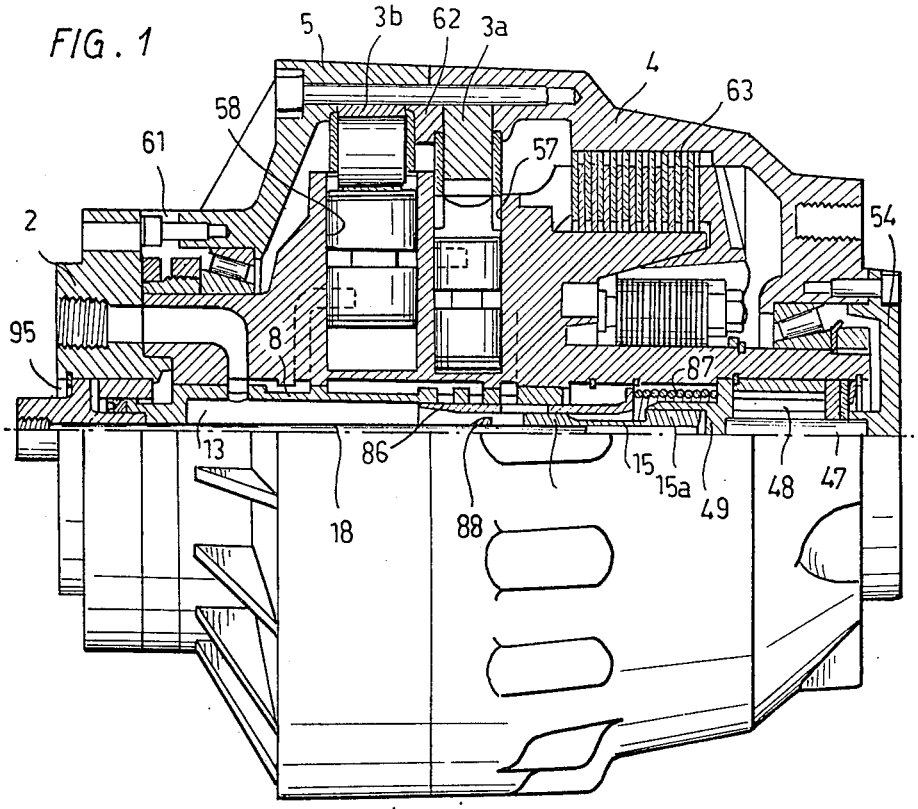
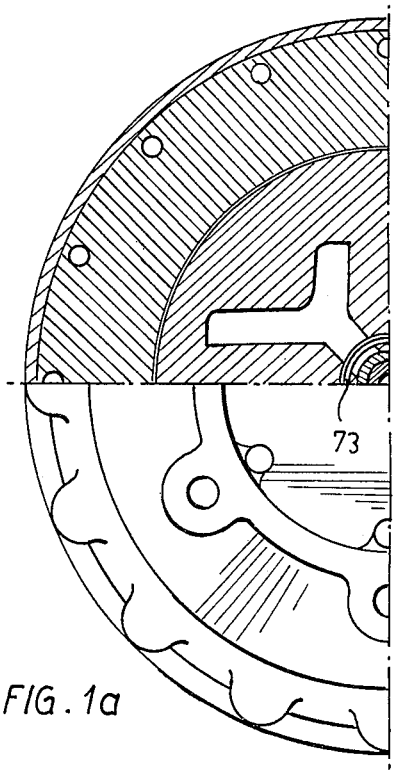
FIG. 1a
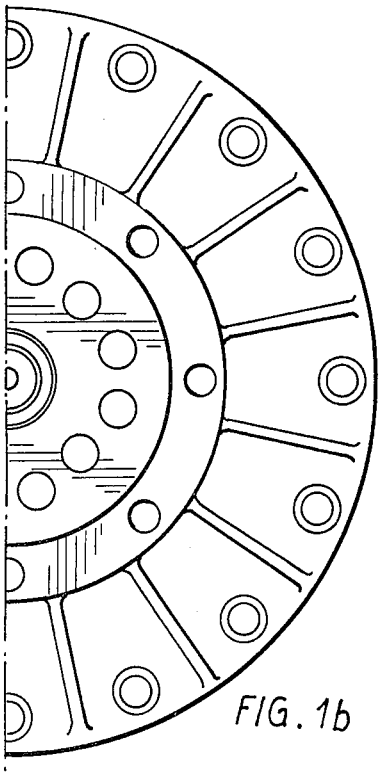
FIG. 1b

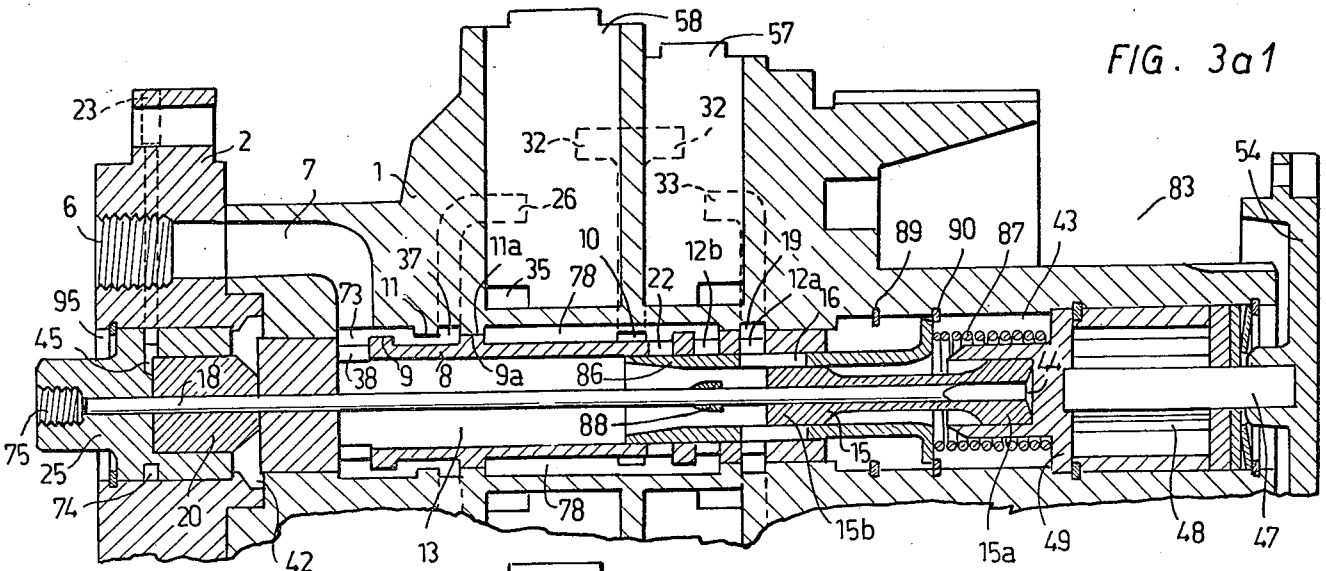
FIG. 3a1
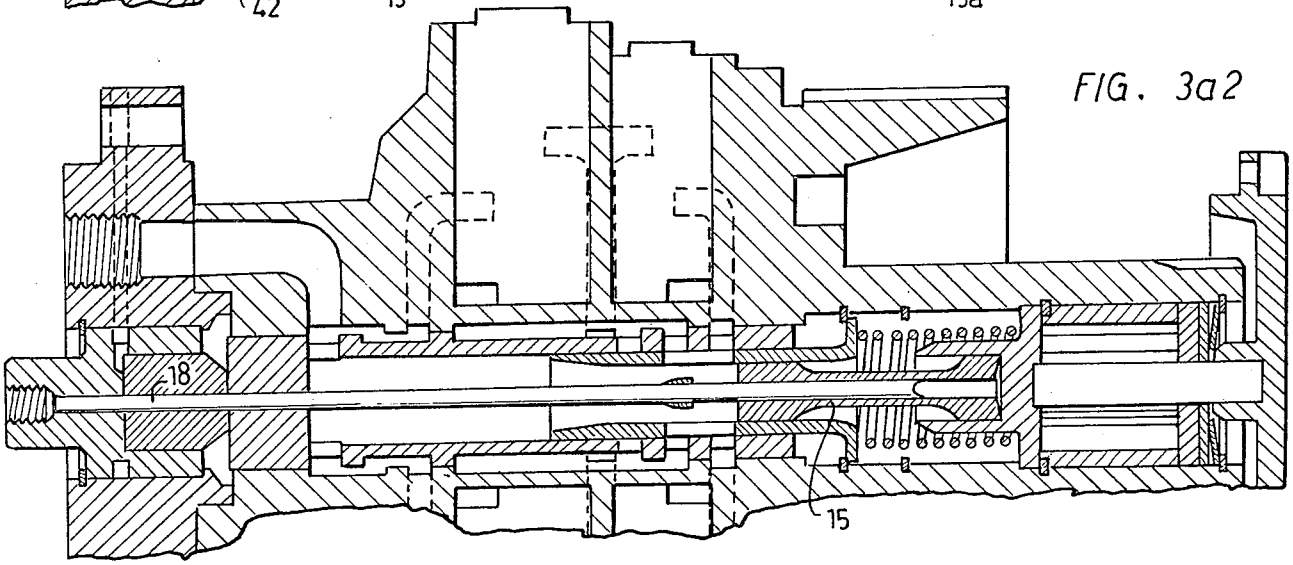
FIG. 3a2

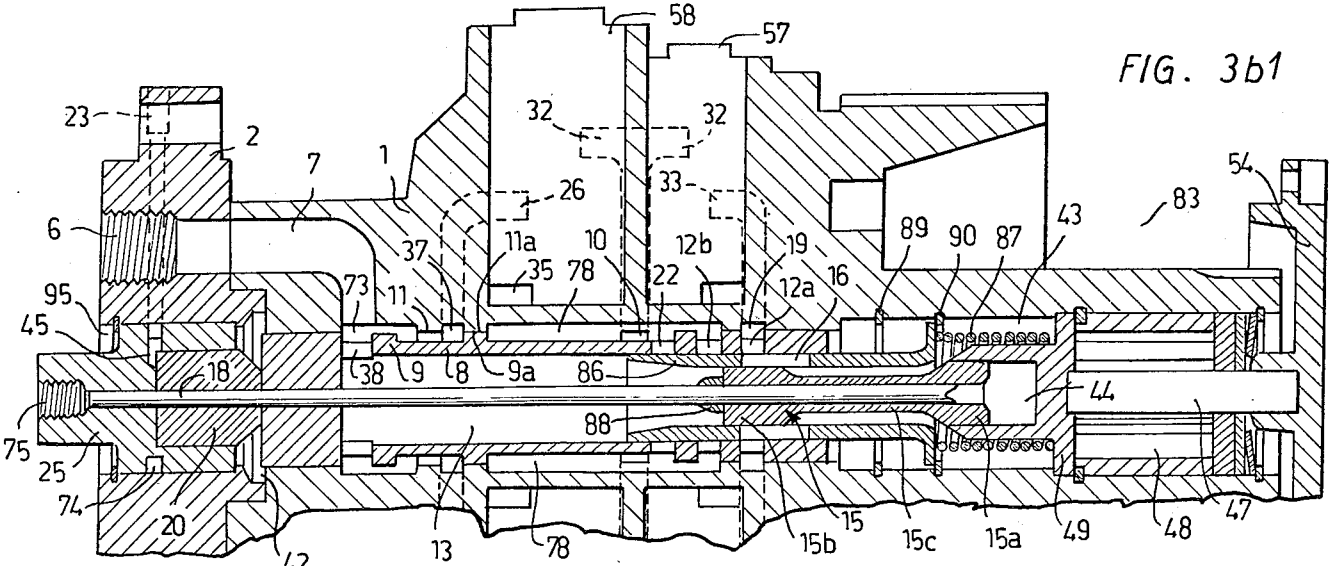
FIG. 3b1
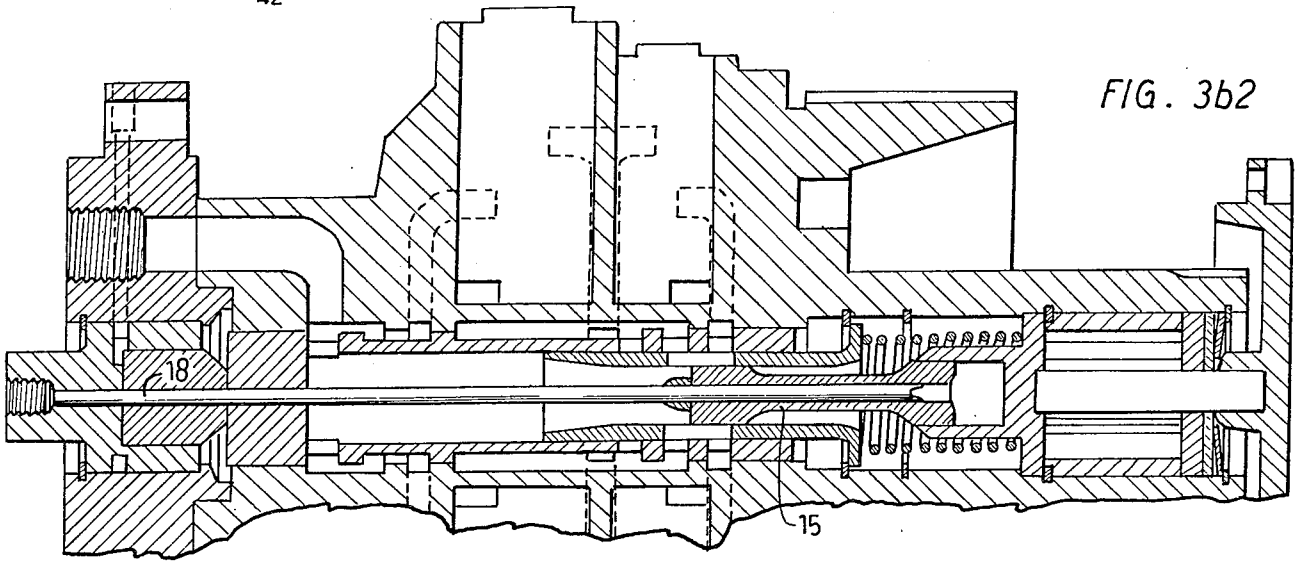
FIG. 3b2

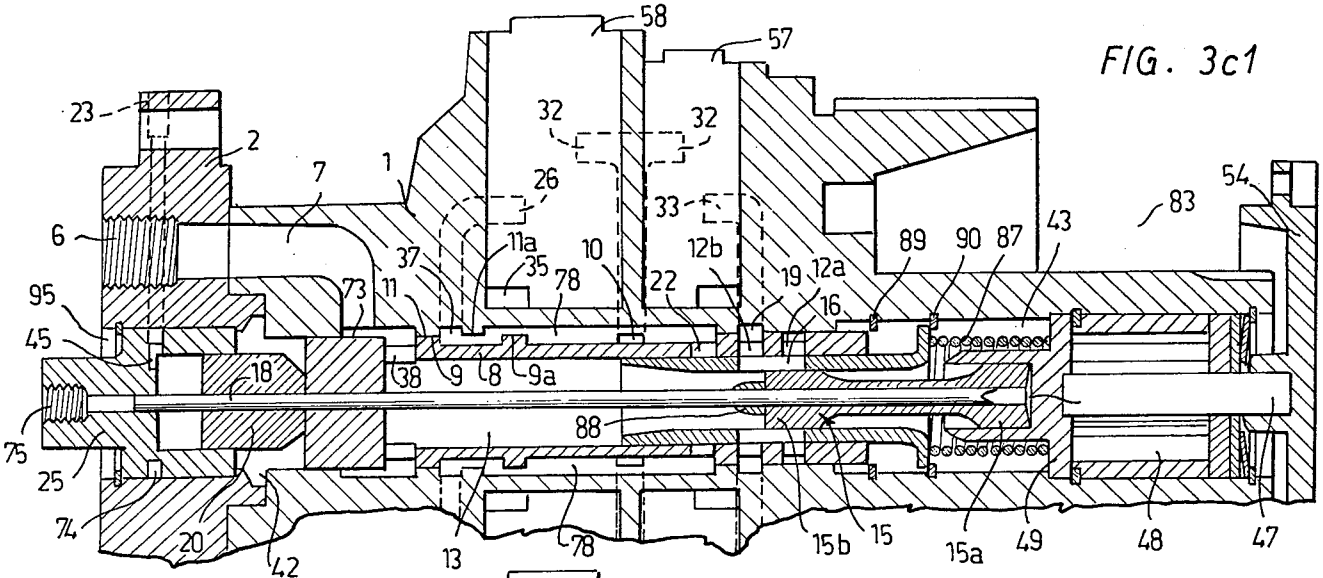
FIG. 3c1
54
83
43
87
90
89
57
58
32
26
11a
35
78
10
12a
16
19
12b
33
22
88
9a
8
9
37
11
38
1
7
73
2
23
6
95
45
18
42
20
25
74
75
13
15
15b
15a
49
48
47
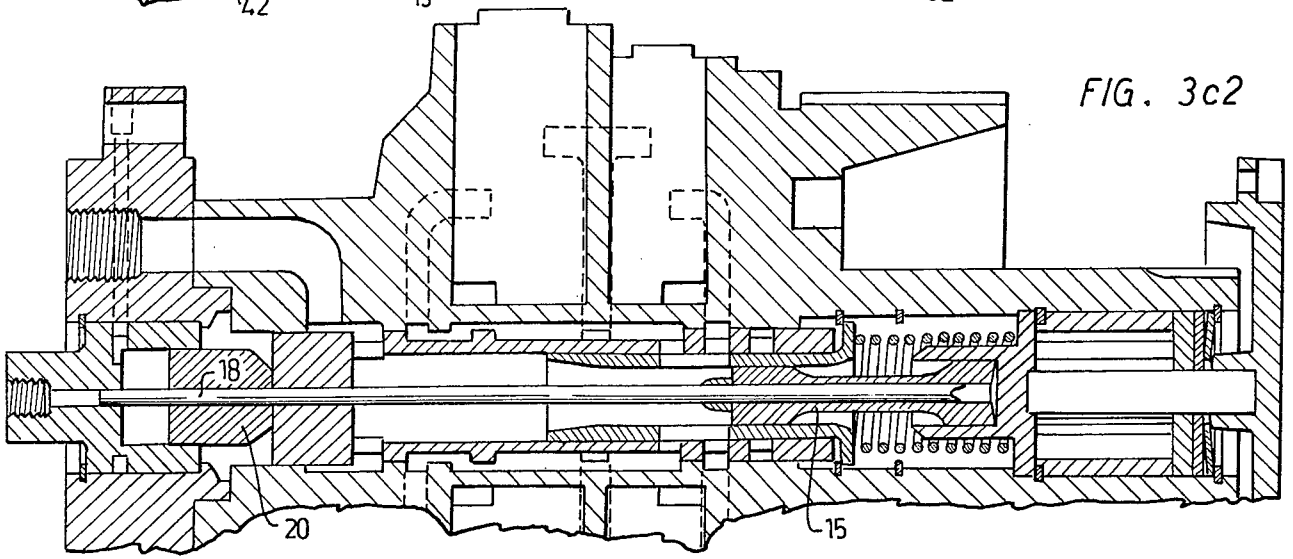
FIG. 3c2
15
18
20

HYDRAULIC MOTOR

BACKGROUND OF THE INVENTION

The present invention relates to a hydraulic motor provided with two cylinder sets with diameters of different sizes and with a sliding spindle valve structure, controlled by the pressure medium being arranged in a bore. This bore, which is formed in the motor shaft, guides the pressure medium alternatively or simultaneously into the larger-diameter cylinder set or into the smaller-diameter cylinder set. In known motors of this kind, the pistons of the cylinder set remaining without pressure medium are guided out of contact with a cam ring whereby the pistons do not participate in the rotation of the motor. This arrangement suffers from the disadvantage that, when reconnecting the deactivated pistons or, for example, when shifting from one gear to another, powerful pressure impulses are produced along with the sudden changes in volume. When the volume of the motor increases while shifting gear, or when the disconnected pistons are thrust into operation, the pistons are unable to engage the cam ring quickly enough. The roller bearings in the ends of the piston hit against the cams of the rotating cam ring, causing impacts in the cam ring and in the bearing. These impacts, especially at higher speeds, may cause damage and shorten the lifetime of the motor.

Due to the above-mentioned circumstances, in a coupling system of this type in which the disconnection takes place in the manner described above for some or all the pistons of the motor, the motor can be run at relatively low speeds of revolution only, and the system can be used in slow vehicles or as auxiliary power when moving at slow speeds, while being disconnected when driving at high speeds.

SUMMARY OF THE INVENTION

It is an object of the invention to provide a new hydraulic motor which eliminates the above-mentioned disadvantage and, in addition, offers advantages by means of which the hydrostatic transmission functions in accordance with the commonly used driving properties and with well-known mechanical transmissions of vehicles.

The hydraulic motor, according to the invention, is characterized with a valve spindle structure, providing a meams for connecting the pressure openings in the cylinder set remaining without pressure medium to a space in which return pressure prevails, and means for connecting the pressure openings in each cylinder set to a space in which return pressure prevails when the working pressure of the motor approaches the return pressure.

The valve system, which, according to the invention, is built into the hydraulic motor and partly carries out automatically the operations to be described hereinafter, while eliminating the disadvantageous phenomena which commonly occur in hydrostatic transmissions under fast driving conditions, such as jerks occurring in connection with shifting, chatters and cavitations caused by the pistons and any damages caused by the foregoing. At the same time, when parallel operations are desired, this construction simplifies the external valve and control assembly of the motors.

According to the invention, when shifting to a higher speed area in connection with the shifting operation, the disconnected pistons will follow the rolling surfaces of the cam ring without requiring any external medium flow and can thus be reconnected into operation without any risks due to impacts. If, during driving, the output of the pump producing working pressure for any reason does not correspond to the quantity of medium required by the driving speed, the valve system, according to the invention, will automatically connect the pressure and return lines to the cylinder spaces in the motor, as the amount of working pressure approaches the value of return pressure. At the same time, the driving force of the hydraulic motor ceases, and the roller means of the pistons, together with the pistons follow the rolling surfaces of the cam rings under the action of the pressure prevailing in the return line. As the output of the motor exceeds the level required by the driving speed, the connecting valve closes due to the increasing pressure on the working side, and the hydraulic motors start their driving work on the selected gear.

A pump which obtains its rotational force from the rotation of the hydraulic motor, is located in the center of the hydraulic motor. When driving forward, said pump operates as a motor; it rotates the hydraulic motor in the driving direction. Also, the pump transfers pressure medium by means of dosing, according to the speed of revolution from the return line to the casing space. Thus, it shifts medium to the working cycle, while converting pressure energy in the return line into rotational work. In normal closed systems, the rotational work is converted into heat when the medium of the working cycle is transferred to the tank. When the medium, in the manner described above, is transferred to the casing line, it flushes and cools said line, while producing in the casing space a small overpressure (1–2 bar) for a complete disconnection-required in a case to be described hereinafter. A back valve, which is connected to the outlet of the casing space, opens under the action of the small overpressure (1–2 bar), allowing the medium to enter the tank line.

If the medium flow from a pump arranged in connection with a power machine for any reason is interrupted—even though the vehicle is in motion—or if the vehicle is hauled without the hydraulic system being in operation, the valve system, according to the patent application, will immediately adjust the hydraulic motors into a complete disconnection. The working pressure circuit is now in a pressureless state. While rotating during forward driving, the pump in the hydraulic motor transfers medium from the pressureless working pressure circuit to the casing space. From the action of the back valve, the above-mentioned small overpressure is produced in the casing space. This overpressure keeps the pistons which are pushed by the cam rings, in the inner positions of their cylinders and allows free rotation of the cam rings. Consequently, the vehicle can be hauled at all driving speeds, like any trailer. The reconnection of the driving hydraulics requires that the vehicle be stationary.

When backing the vehicle, the pressure flow is guided to the return side, whereby the earlier pressure circuit becomes the return circuit. At this moment, the direction of rotation of the motor is reversed; and the hydraulic motors operate only in the range of the first speed, i.e. all cylinders are then in operation and the driving gears must not be used. During backing, the pump built in the hydraulic motors rotates so that it now pumps medium from the casing space through the valve system into the tank line, while keeping the casing space in a pressureless condition.

BRIEF DESCRIPTION OF THE DRAWINGS

In the following, the invention will be described with reference to an embodiment, shown in the accompanying drawings.

FIG. 1 is a longitudinal section of the motor.

FIG. 1*a* is a partially sectioned elevational view of one half of the motor in FIG. 1 as observed from the left side.

FIG. 1*b* is an elevational view of one half of the motor in FIG. 1 as observed from the right side.

FIG. 3*a* 1 is a longitudinal section of the cylinder block of the motor and its valve system in a situation where the motor operates in first gear, and FIG. 3*a* 2 illustrates the situation in which the working pressure of the motor is approaching the return pressure or has reached it.

FIGS. 3*b* 1 and 3*b* 2 illustrate, in the manner of FIGS. 3*a* 1 and 3*a* 2, the operation of the motor in second gear, and FIGS. 3*c* 1 and 3*c* 2, respectively, illustrate the operation in third gear.

DETAILED DESCRIPTION OF THE DRAWINGS

Figure 2:
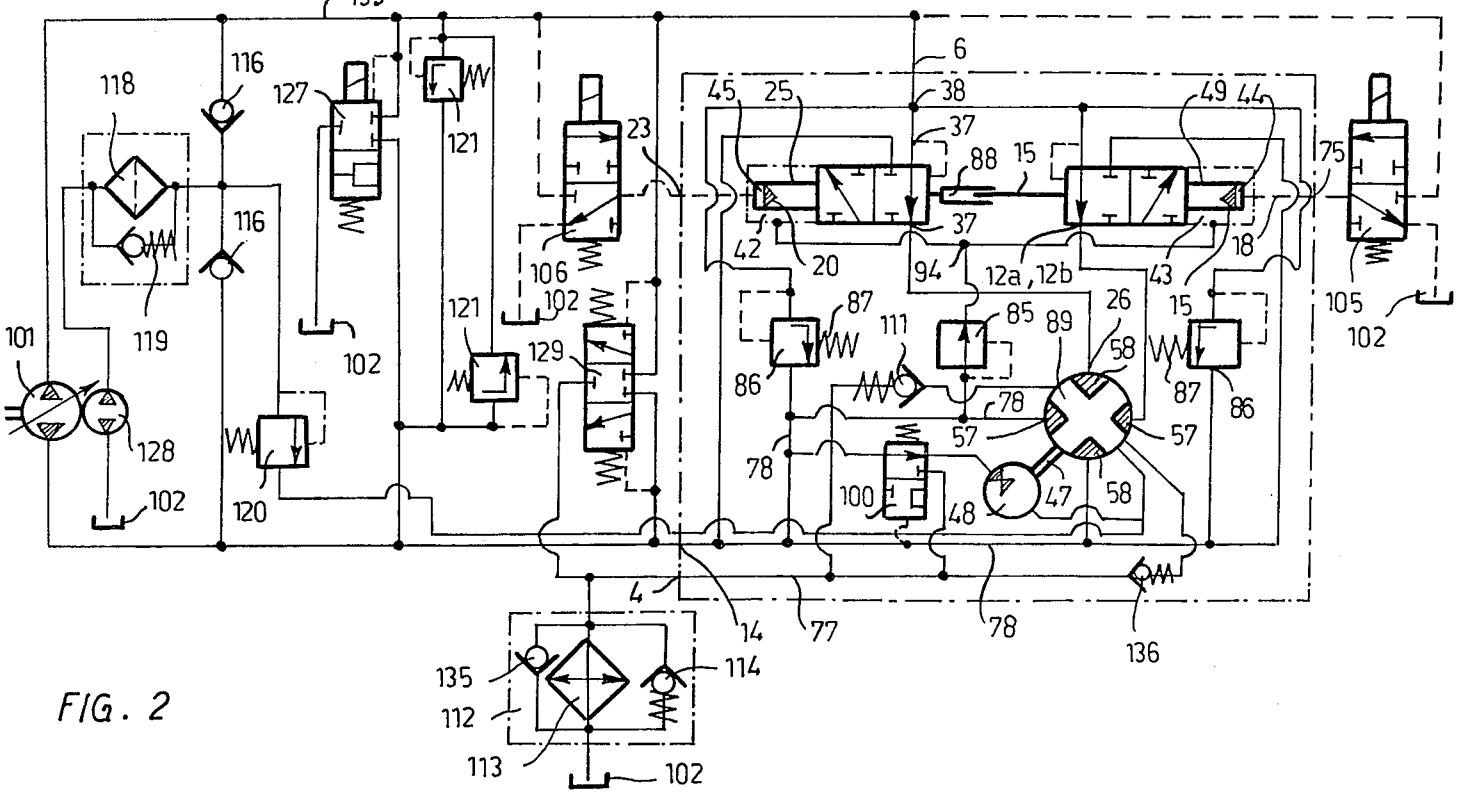
FIG. 2 is a diagram of the motor and of a suitable hydraulic system connected thereto.

In the cylinder block of the motor, there are two cylinder sets of four cylinders each. The cylinders 58 of one set have a larger diameter than the cylinders 57 in the other set. The pressure and return flows as well as the guide flows of the valve system are guided towards and away from the motor through flange 2, which is attached to cylinder block 1 by screws or by some other means. The driving and cooling mediums for the brakes are similarly guided through the flange 2 to the motor. A rotary casing part (FIG. 1) is formed by cover casings 4 and 5, cam rings 3*a* and 3*b*, a seal bow 61 with seals, an intermediate ring 62, a cover 54, brake discs 63, rotating with the casing 4, and a pump 48, rotated by a shaft 47 and the cover 54. As is known in this art, the inlet and outlet passages for each bank of motor pistons is illustrated in FIG. 3*a* 1 in dashed lines between ring groove 37 and inlet openings 26, ring groove 19 and inlet openings 33, and common vent outlet 10 and openings 32.

Figure 4:
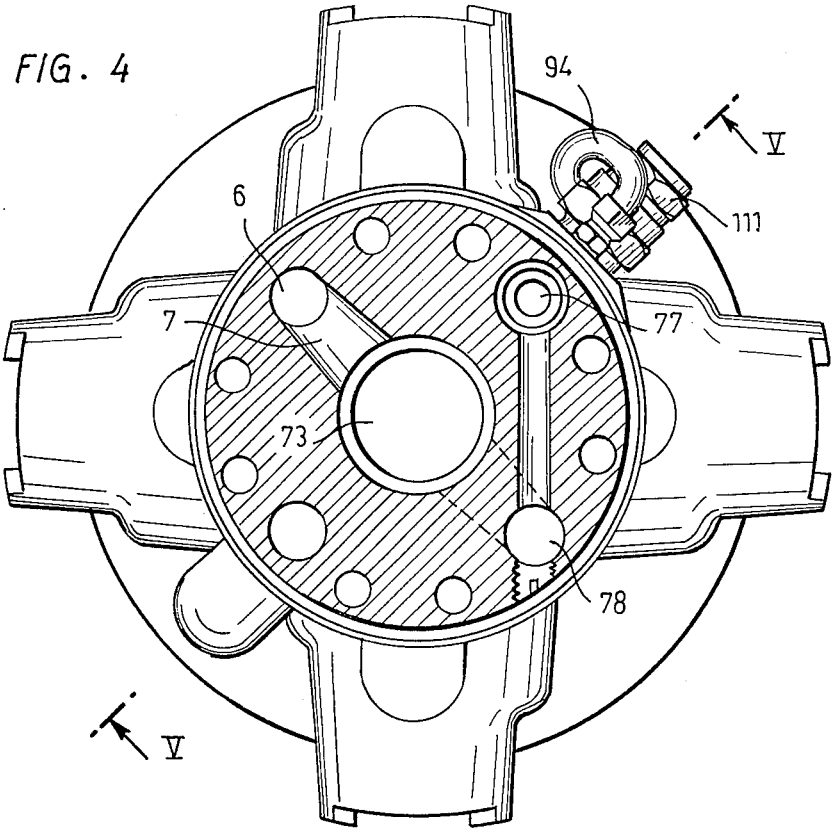
FIG. 4 is a vertically sectional view of the motor, illustrating details of the spindle valve.
Figure 5:
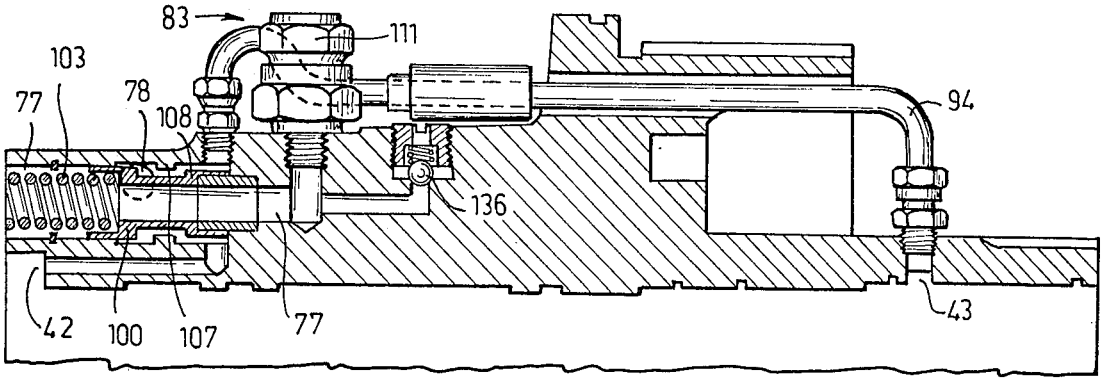
FIG. 5 is a longitudinal section of the tank line in the casing, taken along line V—V in FIG. 4.

A speed change valve system is positioned in a space 73 in the central part of the cylinder block as well as in its extension in the flange 2, bore 95, (FIGS. 3*a*, 3*b* and 3*c*). It is comprised of a spindle 8, which is movable in the axial direction and with a cylindrical hollow space 13, one end of which is open for a sleeve 86, which is movable therein. The other end is provided with an opening, through which passes and in which is fastened or sealed a tube 18. The sleeve 86 is cylindrical and is provided with a flange against which a spring 87 bears. A second spindle 15 is axially movable within the sleeve 86 and is sealed against it. The spindle 15 has a piston at both ends, one, 15*b*, moves inside the sleeve 86, and the other, 15*a*, moves inside chamber 44. In the center of the spindle, 15 there is a bore through which the tube 18 passes, while being sealed against it. The spindle 15 is capable of moving a limited distance along the tube 18, which is provided with a stop 88 for the spindle 15. The tube 18 is fastened to a piston 20, so that it moves together with the piston. When piston 20 pushes spindle 8 to its second extreme position (to the right in the drawing), the stop 88 in the tube 18 pushes the spindle 15 to the bottom of the chamber 44 (FIG. 3*c*). The spindle 15 is thus, able to move in the chamber 44 only when the spindle 8 is in its first position (to the left in the drawing). Spaces 42 and 43 are interconnected by a tube 94 and connected via a precontrolled pressure regulating spindle 100 to space 78 (FIGS. 4 and 5). The spindle 100 is precontrolled from the side of the space 78 so that, as the pressure exceeds the maximum limit for the return pressure, the spindle 100 overcomes a spring force 103 and moves to its second position. Simultaneously, by means of choke parts 107 and 108, spindle 100 blocks the connection from the spaces 42 and 43 to the space 78. During its movement, the spindle 100 has, at the same time, opened the connection from the spaces 42 and 43 to space 77 (FIGS. 4 and 5).

The movement of the sleeve 86 is limited by lock rings 89 and 90, but it is capable of moving within this limited area on the spindle 15 and in the chamber 13 of the spindle 8. In the center of the flange 2, there is a bore 95 with a housing 25. It is provided with a pipe connection 75, from which there is a connection to the cylinder space 44 of the chamber 49 via tube 18 (FIG. 3*b* 1). The tube 18 extends beyond piston 20, as shown in FIG. 3*c* 1. The tube 18 is provided with a normal opening extending therethrough along its length to provide a fluid connection between pipe connection 75 and cylinder space 44 in chamber 49. In the outer mantle of the housing 25, there is a groove 74, from which there is a channel connection to a cylinder 45 (FIG. 3*c* 1). Tube 18 is fastened to piston 20, which is located in cylinder 45. The flange 2 has a pipe connection 23, from which there is a channel connection to the ring groove 74. The housing 25 is fastened to the flange 2 by means of a lock ring, for example, or it may be made integral with the flange 2.

When the pressure flow is guided from the opening 6 through the channel 7 to the space 73, from which it is in continuous connection through openings 38 into the inner space 13 of the spindle 8, the active medium pushes the spindle 15 to the bottom of the cylinder 44 in the chamber 49. The tube 18 is then pressureless. Similarly, the spindle 8 is, at the same time, displaced to its first position as it presses the piston 20 to the bottom of the cylinder 45 in the housing 25 because the cylinder 45 is also pressureless and is in connection through a valve 106 with the tank 102, with which also the tube 18 through a valve 105 is in connection (FIG. 2). Now the medium flow is able to pass through a ring groove 37 to the inlet openings 26 of all the larger cylinders 58. Similarly, the medium flow can flow through openings 16 in the sleeve 86 and through openings 12*a* in the spindle 8 into a ring space 19, from which there are channel connections to the inlet openings 33 of the smaller cylinders 57. The motor then operates with all its cylinders, in first gear (FIG. 3*a* 1). If, the pressure of the medium flow through the connection 6 drops in the space 13 close to the pressure of the return flow in the motor, such pressure will be found in spaces 42 and 43, outside both ends of spindle 8; sleeve 86, under the action of spring 87, will move to its second position against the locking ring 89 (FIG. 3*a* 2). The openings 16 in the sleeve 86 have then been displaced, so that they connect the openings 12*a* and 12*b* in the spindle 8 with each other and, the ring spaces 19 and 78 with each other, and these openings are in communication with both the return channel 78 and the return connection 14 (FIG. 2). Consequently, the pressure in the space 13 is unable to drop below the pressure value of the return circuit; instead, the same feeding pressure, i.e. the return pressure of the motor (in a closed system in general of the order of 10 to 30 bar) prevails during the work and return strokes in all cylinders 58 and 57 in the motor. The pistons are then pressed against the rolling surfaces of the cam ring, but they do not rotate the motor; instead, they brake it slightly. When the medium flow is substantially increased from the working pressure side to the space 13, for example, by increasing the number of revolutions of the motor rotating the pump, or increasing the angle of inclination of the pump or when the driving speed has substantially decelerated, the compressive force acting on the end of the sleeve 86 in the space 13 exceeds the total force of the spring. This action resists the return pressure and the movement of the medium flow and causes the sleeve 86 to be displaced to its first position. Said increase in pressure is caused by the throttling action in the openings 12*b*, due to the increased flow, and this pressure differential occurs between the spaces 13 and 78. The displacement of the sleeve 86 results in the continuation of the operation of the first gear.

When the working pressure of the motor is directed to the tube 18, for example, by means of the valve 105, as shown in FIG. 2, the pressure can act in the cylinder space 44 through the tube 18. The cylindrical portion 15*a* of the spindle 15 has a larger diameter than the cylindrical portion 15*b* in the sleeve 86. Because the pressure now is the same at both end surfaces of the spindle 15, the piston part 15*a*, which has a larger end surface, pushes the spindle 15 into the sleeve 86 against the stop 88 of the tube 18. Thereby, the opening 16 of the sleeve 86 is closed (FIG. 3), preventing medium flow from the space 13 to the opening 12*a*. Consequently, the work of the pistons of the smaller cylinders 57 ceases. At the same time, the spindle 15 has connected the opening 16 in the sleeve 86 through a thinner neck portion 15*c* of the spindle 15 to the space 43 (FIG. 3*b* 1), in which return pressure prevails. As a result the small pistons follow the rolling surfaces of the cam ring. If the pressure in the space 13 again drops close to the pressure of the return side, the sleeve 86 will again operate in the same way, as in the corresponding situation when the motor is in the first gear. The opening 16 in the sleeve 86 will again connect the space 13 to the groove 78 and to the spaces 12*a*-19 (FIG. 3*b* 2). An increased medium flow to the space will again return the sleeve 86 to the first position, and the second gear will continue its operation.

When, in addition, working pressure is directed to the connection 23 by means of a second three-way valve 106 (FIG. 2), it causes displacement of the piston 20 to its second position in the cylinder space 45 (FIG. 3*c* 1). This is possible because the diameter of the piston 20 is larger than the diameters of the space 13 and the larger piston 15*a* of the spindle 15. The spindle 8 and, because of the stop 88, the spindle 15 are pushed until further movement of spindle 15 is prevented by the bottom wall of cylinder 44. As the spindle 8 is displaced to its second position, a widened portion 9 in the spindle is displaced to a throttling point 11 in the chamber of the cylinder block 1, blocking the access of the medium flow from the space 73 into the ring space 37. However, during its movement the spindle 8 has at the same time displaced a second widened portion 9*a* from a second throttling point 11*a* and has opened a connection from the ring space 37 to the ring space 78. The pressure and return spaces of the larger cylinders 58 are now, in turn, under return pressure, and the pistons cease their work and follow the rolling surface of the cam ring (FIG. 3*c* 1).

As the spindle 8 was displaced to its second position, the opening 12*b* was displaced to the ring groove 19. Now, the medium flow from the space 13 is in communication with the ring groove 19 and with the smaller cylinders. The motor now operates, rotated by the small pistons only, in third gear. Also, while the motor is in this state, a pressure drop in the space 13 close to the pressure on the return side causes displacement of the sleeve 86 to its second position, causing a similar slight braking operation, as discussed above for the other gears in the corresponding situations (FIG. 3*c* 2). The return operating state of the third gear takes place in the same way as described above for the other gears.

When shifting from third gear to second gear, the working pressure in the connection 23 is blocked at the point, where it is connected to the tank line. In addition, the action of the pressure in the space 45 ceases and the spindle 8, which is under the action of the working pressure, is displaced back to its first position. As a result, the motor runs in second gear. Similarly, when the working pressure is released from the tube 18, the spindle 15, under the action of the working pressure prevailing in the space 13, is pushed to the bottom of the cylinder 44, causing the first gear to go into operation.

The reverse gear is shifted on, by changing the flow direction of the pressure medium flow. Then the space, 13 and the channel 7 become the return space and the space 78 becomes pressure space. The pressure cycles applied, on the pistons by the cylinders, now act on the other rolling side of the cam of the cam rings, causing the direction of rotation of the motor to change. The motor is able to run in the first speed range only. When the motor runs in the reverse direction, the direction of rotation of the pump has been changed. It now pumps medium from the casing space 83 into the pipe 94 (FIG. 5). The pressure in the space 78 exceeds the return pressure and has caused displacement of the spindle 100 to its second position, whereby it blocks the connection from the space 78 to the space 94. However, while closing said connection, it opens a connection from pipe 94 and from space 42 to a channel 77 (FIG. 5). The channel 77 is connected directly or through a cooler to the tank 102. If the reversing goes on for a long time, or if, for any other reason, under-pressure has a tendency to be created in the casing space during reversing, a valve 136 connected to the channel 77 opens and permits medium to flow from the channel 77 into the casing space 83 (FIG. 5).

In summary, the choke parts 107 and 108 restrict the flow of fluid and provide equal pressure in chambers 42 and 43 when the inlet and the outlet pressures of the motor are equal as follows.

When the motor is running forward, channel 78 constitutes a part of the return flow (outlet) channel as previously explained. Valve 100 is in the position shown in FIG. 5, with the choke parts or lands 107 and 108 providing communication from 78 to space 42 through line 94. As the inlet pressure approaches or equals the outlet pressure during forward running, valve 100 just remains in the position of FIG. 5, and the lands 107, 108 do not restrict the flow of fluid.

When reversing the motor, the space 78 receives the inlet pressure, which eventually forces the valve 100 to the left in FIG. 5 against the spring 103 (the left face of the valve at the reference line of 100 is larger than the opposite face of the land 108) to abutment against stops shown between the reference lines of 77 and 103. The lands 107 and 108 now coincide and block the connection from 78 to 42 and 43. At the same time, the right hand edge of the valve 100 (land 108) opens a slit to line 77, connecting spaces 42 and 43 therewith.

The manner in which the inlet pressure is directed, or not, to chamber 45 should be apparent both with reference to FIG. 2 (valve 106) and the description of operation above relating to FIGS. 3*c* 1 and 3*c* 2 (connection 23).

If the vehicle is hauled without any pressurized medium being fed into the hydraulic motors, the pump 48 pumps forward-hauling medium from the channel 78 through valve 134 of tank 102. When this medium is pumped into the casing space 83, it raises the pressure in the casing space to a pressure, the value of which is determined by pressure regulating valve 111, and it keeps the pistons, which are pushed by the cams in the cam rings 3*a* and 3*b*, in the inner positions of the cylinders. Thus, and the vehicle can be hauled at any driving speed. For example, valve 127 can be electrically controlled, in which case it must be switched on before hauling; or the valve can be pressure controlled, e.g., from the return line so that after the pressure has ceased, the valve is opened under the action of a spring force, whereby hauling can be started without any preliminary procedures.

In FIG. 2, numeral 101 denotes the main pump of the system. The volume of said pumps can be changed, for example, by changing the angle of inclination. Numeral 128 denotes a feed pump, which feeds the return circuit of a closed system through back valves 116. Numeral 118 denotes a fine filter. The pressure of the feed circuit or of the return circuit is regulated by means of a valve 120. The pressure and return circuits can be electrically or pressure controlled, can be interconnected by means of a valve 127, and simultaneously can be connected to the tank 102. Valves 121 are limiting valves for the maximum pressure of the working pressure. If the pump 48 is unable to flush the closed circulation system sufficiently, especially when backing occurs frequently, valve 129 may alleviate this problem.

What I claim is:

1. A hydraulic motor provided with two cylinder sets arranged around a shaft and having diameters of different sizes with a sliding spindle valve structure, having fluid pressure reactive surfaces thereon, controlled by the pressure medium being arranged in a bore formed in the motor shaft for directing the pressure medium alternatively to both cylinder sets, to the larger-diameter cylinder set only or to the smaller-diameter cylinder set only, characterized in that the valve spindle structure comprises means for connecting the pressure openings of the cylinder set remaining without pressure medium to a space in which return pressure prevails, and means for connecting the pressure openings in both cylinder sets to the return pressure when the working pressure of the motor approaches the return pressure, said connecting means including said sliding spindle valve which slides in response to a pressure differential thereacross, on fluid pressure reactive surfaces of the spindle valve, between the working pressure and the return pressure.

2. A hydraulic motor as claimed in claim 1, in which the valve spindle construction comprises a first hollow valve spindle which is movable between two positions and has in its mantle a first opening for connecting the inner space of the spindle to a pressure channel in both positions of the spindle, a second opening communicating in the second position of the spindle with a ring groove leading to pressure openings in the smaller cylinder set, a third opening communicating in the first position of the spindle with said ring groove leading to the pressure openings of the smaller cylinder set, a second hollow valve spindle arranged displaceable within the first spindle so that its mantle in the first position of the second spindle in relation to the first spindle permits communication from the inner space of the first spindle to the pressure ring openings of the smaller cylinder set through the third opening in the first spindle and in the second position of the second spindle in relation to the first spindle blocks this connection, and a piston for displacing the first valve spindle;

characterized in that the first spindle has a smaller outer diameter than the diameter of the central bore in the cylinder block so that around the first spindle is formed a ring passage one part of which communicates with the pressure channel and the other part of which communicates with a return channel, that an annular projection is provided in the inner wall of the bore in the cylinder block on both sides of the ring groove leading into the pressure openings of the larger cylinder set, that the mantle of the first spindle is provided with corresponding projections cooperating with said projections and arranged so that, in the first position of the first spindle, the first pair of projections permits communication from the pressure channel to the ring groove while the second pair of projections blocks the communication from the ring groove to the return ring space and, in the second position of the first spindle, the first pair of projections blocks the communication from the pressure channel to the ring groove while the second pair of projections opens the communications from the ring groove to the return ring space that the mantle of the first spindle is provided with a fourth opening which, in each position of the spindle, communicates with the return ring space, and that between the first spindle and the second spindle, there is arranged a third spindle which is slideable tightly along the first spindle and the second spindle between two positions and whose mantle is provided with an opening so dimensioned that it, in the first position of the third spindle, is located at the ring groove leading into the pressure openings of the smaller cylinder set through the second opening and the third opening of the first spindle and, in the second position of the third spindle, connects the ring groove leading to the pressure openings of the smaller cylinder set to the return ring space through the second and third opening of the first spindle or through the fourth and second opening of the first spindle, whereby the motor operates.

in first gear when the first spindle is in its first position and the second spindle simultaneously is in its first position in relation to the first spindle, in second gear when the first spindle is in its first position and the second spindle simultaneously is in its second position in relation to the first spindle, and in third gear when the first spindle is in its second position, while the third spindle carries an internal pressure return connection in all gears when located in its second position.

3. A hydraulic motor as claimed in claim 2, in which the movement of the second spindle in relation to the first spindle is limited in the first position by a closed end of a housing in the bore in the shaft, a cylinder space limited by the housing and the spindle being connected to a pilot valve of the second valve spindle through a tube extending through the first spindle and the piston, and in which the end of the second spindle in the housing is larger than the end in the inner space of the first spindle, characterized in that the movement of the second spindle in relation to the first spindle is in the second position limited by a stop fastened to a said tube, and in that the second spindle is provided with a neck portion forming a connection from the ring groove leading to the pressure openings of the smaller cylinder set through a mantle opening in the third spindle to a space in which return pressure prevails, when the second spindle is in its second position in relation to the first spindle and the third spindle at the same time is in its first position.

4. A hydraulic motor as claimed in claim 2, characterized in that one end of the third spindle extends into said space in which return pressure prevails, and in that a spring force is, in addition, arranged to act on this end, the third spindle being in its first position when the pressure prevailing in the inner space of the first spindle is higher than the return pressure prevailing in said space added to said spring force and being displaced to its second position by means of the spring when the pressure prevailing in said inner space of the first spindle approaches the return pressure.

5. A motor as claimed in claim 4, characterized in that the connection from the return space to the space having return pressure acting on the third spindle is blocked when the pressure in the return space exceeds a maximum feed pressure whereby, when the direction of rotation is changed and the return space becomes the working pressure space, a valve which is precontrolled from the return space side blocks the connections from the return space to the space having return pressure acting on the third spindle as soon as the pressure has been exceeded.

6. A hydraulic motor as claimed in claim 4, characterized in that the end of the third spindle extending into said return pressure space is provided with a flange arranged to hit against fixed stops for limiting the movement of the spindle.

7. A hydraulic motor as claimed in claim 6, characterized in that the flange of the third spindle hitting against said stops at the same time forms in said space a throttle which decelerates the speed of movement of the third spindle.

8. A hydraulic motor as claimed in any of the preceding claims, characterized in that the return channel and a casing space are interconnected by a pump which is connected to the rotation of the casing part so that, as the casing part rotates forwards, the pump functions as a hydraulic motor while assisting the rotation of the casing parts, and while transferring pressure medium by means of dosing, according to the rate of rotation from the return space, to the casing space and when the entire hydraulic system is in a pressureless condition with respect to the hydraulic motor and when the pressure and return lines are connected to the tank line, pressure is produced in the casing space up to the pressure value determined by a valve for pushing the pistons to their innermost positions in their cylinders, whereby the cam rings of the motor are, while rotating, disengaged from the roller means of the pistons and the casing parts of the motor can rotate freely while the motors operate as conventional load-carrying wheels.

9. A hydraulic motor as claimed in claim 8, characterized in that, when backing the vehicle, i.e. when reversing the direction of rotation of the motor, when the working pressure is fed into the return channel and the return to the pressure channel, the working pressure precontrols a valve so that the working pressure cannot reach the pump, but, instead, effects the connection of the pressure side of the pump to the tank line whereby the motor, during its rotation, by means of the pump, transfers medium that has leaked into the casing into the tank line.

* * * * *